US008566996B1

(12) United States Patent
Nezat, II et al.

(10) Patent No.: US 8,566,996 B1
(45) Date of Patent: Oct. 29, 2013

(54) SKID SYSTEM FOR A ROOT CUTTER

(75) Inventors: Malvin A. Nezat, II, Splendora, TX (US); Michael J. Hnatek, Splendora, TX (US)

(73) Assignee: Malvin A. Nezat, II, Splendora, TX (US)

( * ) Notice: Subject to any disclaimer, the term of this patent is extended or adjusted under 35 U.S.C. 154(b) by 277 days.

(21) Appl. No.: 13/189,541

(22) Filed: Jul. 24, 2011

(51) Int. Cl.
*B08B 9/02* (2006.01)

(52) U.S. Cl.
USPC ..... 15/104.31; 15/104.18; 15/104.04

(58) Field of Classification Search
USPC ..... 15/104.12–104.19, 104.03–104.04, 15/104.09, 104.315
See application file for complete search history.

(56) References Cited

U.S. PATENT DOCUMENTS 4,766,631 A 8/1988 Crane

OTHER PUBLICATIONS

Website for EHLE HD, homepage with sewer cleaning equipment: http://www.ehle-hd.com/en/__rubric/index.php? rubric=73.
Website for EHLE HD for piper and sewer equipment with root cutters: http://www.ehle-hd.com/en/__rubric/index.php? rubric=6.
Website for Sewer Equipment Company of America with root cutter: http://www.sewerequipment.com/jetting__rootcutters.htm.
Website for Sewershop.com with root cutter: http://www.sewershop.com/cutters/partriot-2-91083-00-f.html.
Shamrock Pipe Tools, Inc. Product Catalog for root cutters from URL: http://www.3tequipco.com/shamrockcuttercatalog.pdf.

*Primary Examiner* — Shay Karls
(74) *Attorney, Agent, or Firm* — Marsteller & Associates, P.C.

(57) ABSTRACT

A removable frame system (100) consists of a first end (101) and a second end (102) and is made up of at least two side frame components (103 & (107) where all said side frame components are single piece components with no adjustments or added parts. Side frame components (103 & 107) form a pivoting body capable of swinging open and closed to form a payload cavity (113) desirable to contain a payload subsystem (112) that is designed to operate a payload application device (115). There are only three components that make up the remote frame system (100) that supports the operation of the payload (112). Removable frame system (100) supports rugged operation and in the field re-configuration for a multiple of purposes. One embodiment is to be deployed in the sewers as a root cutting system that employs a motor for the payload (112) and a root cutter for the payload application device.

16 Claims, 4 Drawing Sheets

SKID SYSTEM FOR A ROOT CUTTER

BACKGROUND OF THE INVENTION

1. Technical Field

The invention relates to the field of sewer and conduit service and monitoring systems, and more particularly, to a system that can be deployed to remove plant roots and root systems that have invaded into a sewer pipe system.

2. Background Art

Sewer and conduit service and monitoring systems are used generally by maintenance and security operations groups for maintaining, diagnosing, repairing, and securing of tube and conduit systems. Generally, these sewer and conduit service and monitoring systems are utilized wherever human beings cannot physically go due to space or environmental considerations, where maintenance and security issues remain to be addressed by a remote operations staff.

The types of tasks addressed by sewer and conduit service and monitoring systems include, but are not limited to gas sampling, sewer or conduit integrity, security inspections in search of threats such as explosives, toxins, poisons, infectious substances, and general sewer system inspections.

The crumbling of infrastructure that most countries are struggling with today is increasingly affecting sewer and conduit systems creating a growing number of crises in both urban and rural locations. To address these described situations, increasing dependence is being placed on sewer and conduit service and monitoring systems. For example, a sewer system can be inspected to determine if it needs immediate attention, is being exposed to unwanted toxins, or is in general need of attention. A record of these findings can be made and used as a tool in the triaging of a city's entire sewer system to determine which areas are to be focused on in the near-term and to set a priority level for the remaining sections of the system.

It is often the case that during a sewer system inspection or maintenance activity, the sewer and conduit service and monitoring systems cannot get to all of the areas of the sewer due to plant roots that have invaded into the sewer system and thereby have blocked passage of the sewer and conduit service and monitoring systems, and possibly even the water or effluent that the sewer was intend to support.

Sewer root clearing systems are known and are used to address the problem of roots invading into a sewer system. For example, chemical foams can be used, such as RootX®, but they take time to take effect and have limited success with large roots. High pressure water or fluid systems can be used in some areas, but also have limited success with large roots. Mechanical cutting systems are deployed to clear roots from sewer systems, but are hampered by the breakage of parts and adjustment mechanisms therefore delaying or even halting the root clearing process.

One example of a mechanical root cutting system can be found in Patrick R. Crane's "Sewer Pipeline Hydraulic Root Cutter Apparatus," U.S. Pat. No. 4,766,631. This root cutting system is fixed in configuration and does not allow for the modification of payload: for example, from root cutter to sewer inspection sensor. This places a burden on the operations staff to carry complete and separate systems for anything other than root cutting. Additionally, the apparatus of Crane is configured with multiple parts on the sewer skids, and skids that are mechanically attached and adjusted: leading to breakage or loosening of the skid. These problems then further delay the actual sewer inspection and maintenance that was required in the first place before the roots were discovered. What is needed is a root cutting system with far fewer parts and components that can cut roots and be redeployed for required maintenance and service operations.

However, such a sewer and conduit service and monitoring system has not been used in the field of sewer and conduit maintenance. There are numerous reasons for this nonuse, such as lack of an available apparatus with fewer parts and a design appropriate for multipurpose field use.

While the above cited references introduce and disclose a number of noteworthy advances and technological improvements within the art, none completely fulfills the specific objectives achieved by this invention.

DISCLOSURE OF INVENTION

While known approaches have provided improvements over prior approaches, the challenges in the field of sewer and conduit service and monitoring systems have continued to increase with demands for more and better techniques having greater effectiveness. Therefore, a need has arisen for new methods and systems for maintaining and servicing sewers and conduits.

In accordance with the present invention, a sewer and conduit service and monitoring systems includes a removable frame system capable of performing as a root cutting system with a minimum of parts and components, as compared to existing systems, that can remove roots from sewer pipes and be redeployed for other required maintenance and service operations such as inspections within the sewer pipe system.

Types of tasks performed by the removable frame system include, but are not limited to: gas sampling, sewer or conduit integrity, security inspections in search of explosive devices or other security threats, toxic and poisonous liquid sampling, and sewer system maintenance. The present invention is designed to be deployed, at a minimum, in support of all of these tasks. The removable frame system can additionally perform as a root cutter when required to remove plant roots that have invaded into the sewer system and prevented the required maintenance, service, or inspection.

In accordance with the present invention, the removable frame system supports a suitable number of configurations that perform said sewer maintenance and service by employing an architecture that consists of at least two side frame components that readily open about pivot points located within the each side frame component. The removable frame system can then contain a payload and payload application device suitable for sewer or conduit maintenance and service. The side frame components allow quick changes from one payload to another while still remaining rugged enough to endure long stretches of field use. Each side frame component is a single piece construction made up of a set of body subcomponents that form the size and configuration of the removable frame system enabling a set of wing subcomponents that position the body and payload within a sewer pipe or conduit. The side frame components are capable of withstanding rugged field use without breaking or falling out of adjustment.

As an example, an embodiment of the present invention would consist of a payload and payload application device consisting of a set of power and control electronics and a video camera. This configuration can be deployed into a sewer or conduit system to inspect and record the condition of said system. Within the sewer system, the removable frame system is likely to encounter an area that has been invaded by plant roots, making the completion of video inspection of the sewer system impossible. Within the described embodiment of the present invention, the removable frame system is then removed from the sewer system; the power and control electronics and video camera are removed from the removable frame system by unlocking the side frame components and simply pivoting open the side frames and removing said payload and payload application devices. A motor and root cutter can now be installed within the removable frame system and the entire removable frame system redeployed into the sewer system to cut and clear all roots within the planned service and maintenance area within the sewer system. Once the area of interest is clear of roots, the removable frame system can be retrieved from the sewer system and redeployed as a video system, as previously described above, to complete the maintenance and service in the form of recorded video surveillance of the planned area of the sewer system.

These and other objects, advantages and preferred features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

Figure 1:
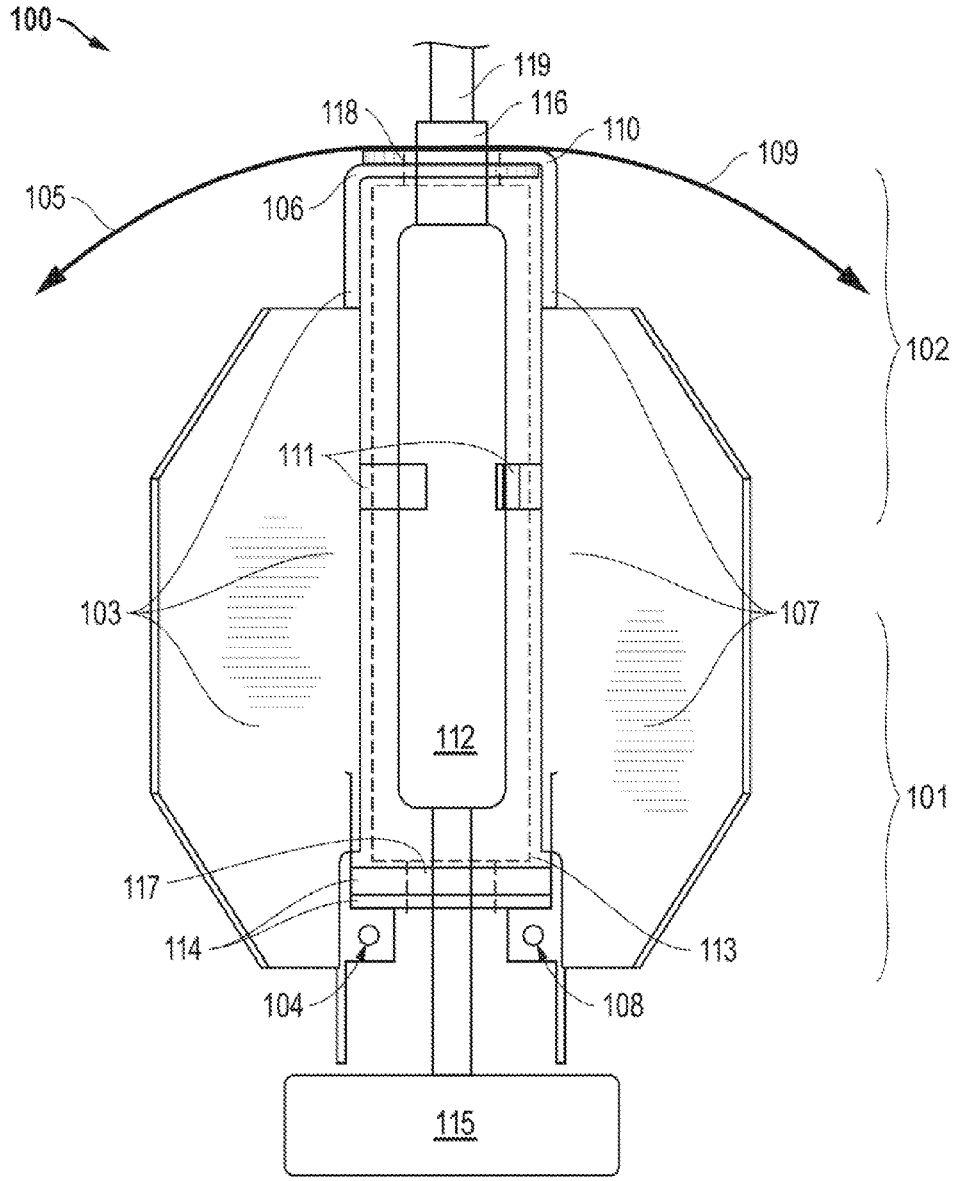
FIG. 1 is a side view of a removable frame system in the mated position with payload and payload application device.
Figure 2:
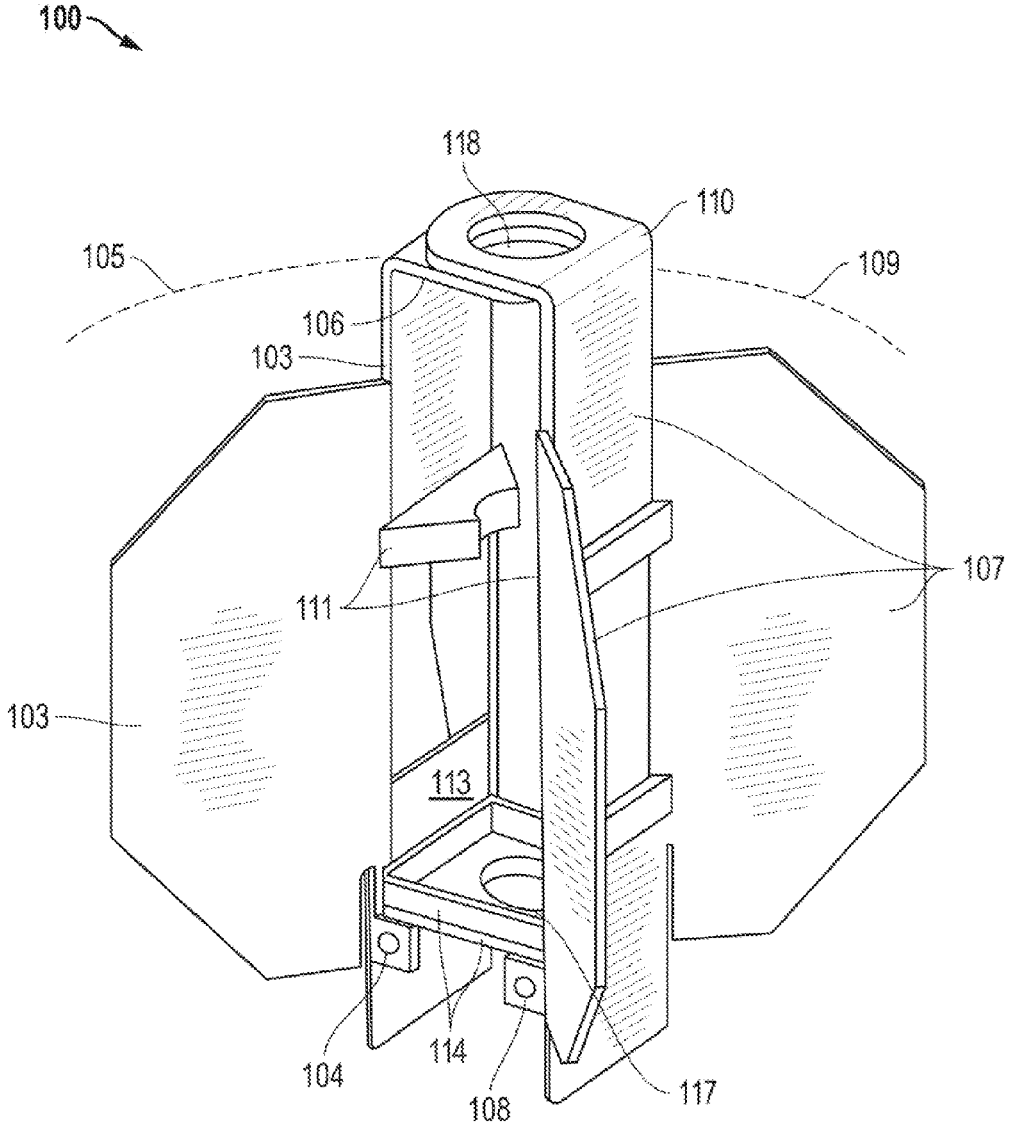
FIG. 2 is an oblique view of a removable frame system in the mated position without payload and payload application device.

FIGS. 1 and 2 illustrate side and oblique views, respectively, of a removable frame system 100 in the closed or mated position. FIG. 1 illustrates the enclosing and supporting of a payload subsystem (payload) 112 and a payload application device (device) 115. FIG. 2 offers an oblique view without the payload 112 or the device 115 for a different view of the composition of the removable frame system 100. The removable frame system 100 consists of a first end 101 and a second end 102 and is made up of a set of at least two side frame components (103 & 107). In the illustrated embodiment of the present invention there are two side frame components: a first side frame component 103 and a second side frame component 107. To adapt to a pipe or conduit of a larger size, more side frame components can be added to the minimum set of two side frame components or at least two larger side frame components can be used. At least two side frame components (103 & 107) form a pivoting body capable of opening and closing to form a payload cavity 113 required to contain and support the payload 112 and allow a connection of the device 115 to said payload 112.

FIGS. 1 and 2 further illustrate each side frame component pivoting about its respective pivot points. The first side frame component pivot point 104 allows said side frame component to pivot in direction 105. The second side frame component pivot point 108 allows said side frame component to pivot in direction 109. The pivot points (104 & 108) are anchored within a plate member 114 where said plate member also allows the payload 112 direct access to the device 115 via a plate member void 117. The payload 112 is steadied to each side frame component (103 & 107) by a payload brace 111. The steadying of the payload 112 can be performed by simple restriction by the braces 111 or the payload 112 can be attached to the braces 111 by a screw or other fastener. The securing of the payload 112 by each single side frame component (103 & 107) via braces 111 stabilizes operation and allows for multiple payloads 112 to be utilized in the field with the remote frame system 100. Taken together, these features uniquely form a rugged frame system capable of carrying a multitude of payloads 112 and devices 115 and apply them in a durable removable frame system 100 appropriate for field use.

With continued reference to FIGS. 1 and 2, within the illustrated embodiment of the present invention, each of the mating plates (106 & 110) possess a void 118 such that each mating plate void 118 aligns with the other mating plate voids 118 when all the side frame components are pivoted into the closed or mated position. The voids allow a connection hose adapter 116 to pass through and connect to the payload, effectively locking all side frame components into the closed or mated position and forming an operational state of the removable frame system 100. This locking state will remain effective, keeping the removable frame system 100 in an operational state, until such time as the connection hose adapter 116 is removed. This construction allows for the removable frame system 100 to consist of a small number of parts with no alignments or adjustments required and is therefore very durable and adaptable in the field. This simple and effective opening and closing remote frame system 100 requires only a minimum of components to perform effectively and is capable of supporting multiple payload missions within a single operations staff fielding.

Figure 3:
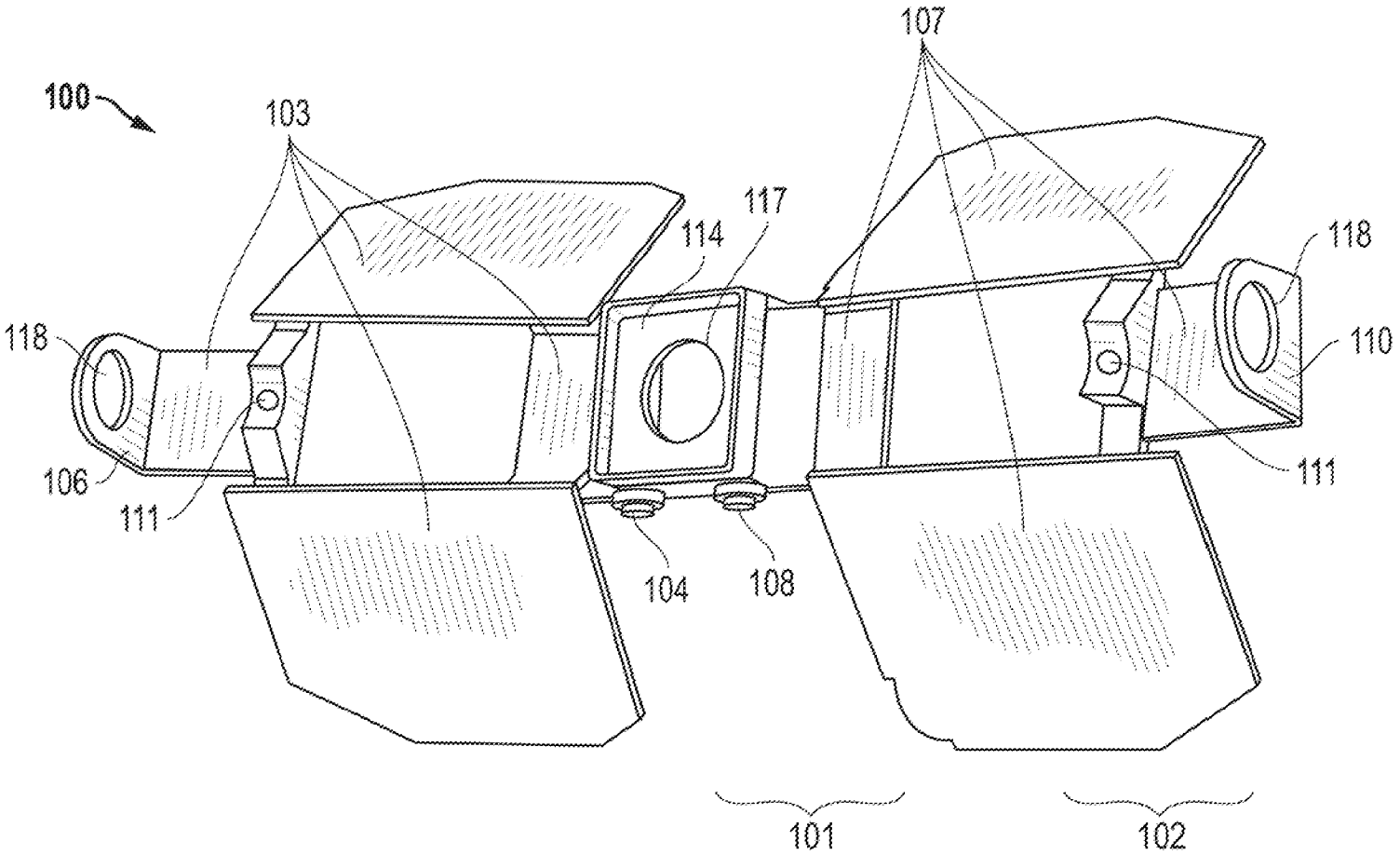
FIG. 3 is an open view of a removable frame system in the non-mated position without payload and payload application device.

FIG. 3 illustrates an open view of the removable frame system 100 in the open or non-mated position without the payload 112 and the device 115. Within this illustrated embodiment of the present invention, it is evident that the plate member 114 is at the center of the removable frame system 100. When configured for two side frame components as in the present embodiment of the invention, said plate member 114 forms the anchor of the pivot points (104 & 108) for each side frame component (103 & 107) as well as defining two dimensions, width and height, of the payload cavity 113. In the open or non-mated position the payload braces 111, permanently attached to the side frame components (103 & 107), are easily accessible and are defined to fit precisely the intended payloads 112 to be carried by the removable frame system 100. The third dimension of the payload cavity 113 is defined by the length of the side frame components (103 & 107).

There are only three components that make up the remote frame system 100 that supports the operation of the payload 112 and its device 115. The design simplicity of said system supports rapid and direct repair or replacement of payload 112 and devices 115 and is designed to be very rugged as the invention requires no small parts that might come loose and there are no adjustments that need to be made and remade.

With further reference to FIG. 3, the three-piece design of the remote frame system 100 supports the implementation of a set of payload 112 and device 115 pairs where each said pair can be rapidly accessed for repair or replacement with another payload 112 and device 115 pair. The remote frame system 100 can therefore be configured for a desired number of required field operations with a minimum of field equipment. Previously, each payload 112 and device 115 pair required its own system to deploy and operate. One single remote frame system 100 can now be carried into the field with a set of payload 112 and device 115 pairs to address required operations and minimize the number of return trips per operation.

With continued reference to FIG. 3, the three-piece design of the remote frame system 100 supports a wide ranged pivot motion between open and closed states of the side frame components (103 & 107) of the remote frame system 100 thereby supporting quick access to the payload 112 and device 115 in field operation which allows for rapid change in the deployment of remote frame system 100 with a minimum of parts and components to break or fall out of adjustment.

Figure 4:
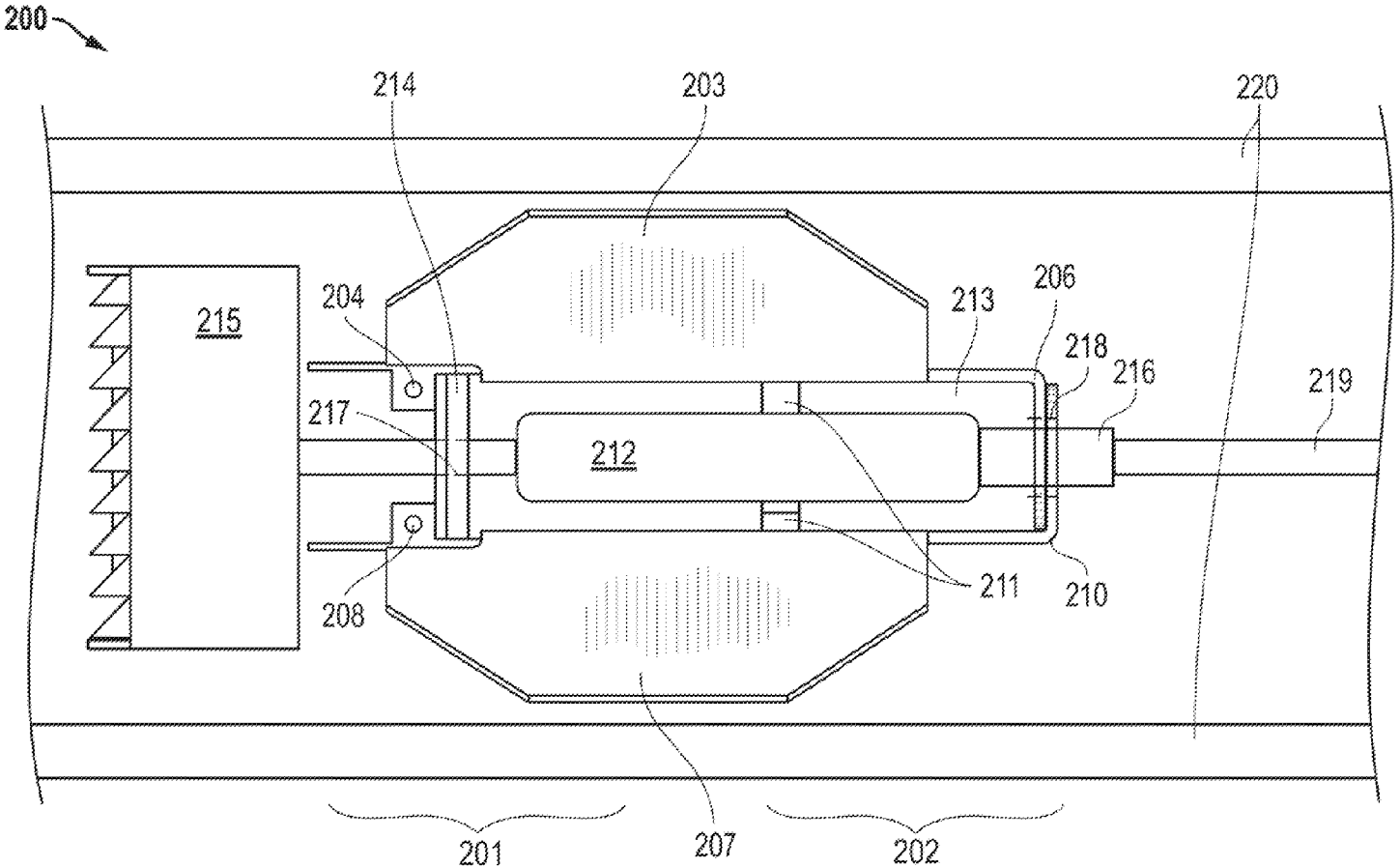
FIG. 4 is a side view of a removable root cutting system in the mated position with motor drive subsystem (motor) and root cutting device, deployed into a sewer system.

FIG. 4 illustrates a side view of a removable root cutting system 200 embodiment of the present invention in the closed or mated position with a motor drive subsystem (motor) 212 and root cutting blade (blade) 215, deployed into a sewer system (220). The removable root cutting system 200 is meant to be deployed within the pipes of a sewer system 220 where the side frame components (203 & 207) position the motor 212 and blade 215 to a desired position within the sewer tube 220. The removable root cutting system 200 consists of a first end 201 that contains the blade 215 and a second end 202 that contains the connection hose adapter 216 and is made up of a first side frame component 203, and a second side frame component 207.

With continued reference to FIG. 4, the removable root cutting system 200 can adapt to the size of the sewer or conduit. More side frame components can be added to make the removable root cutting system 200 fit a larger diameter sewer, or larger side frame components (203 & 207) can be adapted to make the removable root cutting system 200 fit a larger diameter sewer. The two side frame components (203 & 207) form a pivoting body capable of opening and closing to form a motor cavity 213 required to contain a motor 212 that is designed to operate a blade 215. The motor 212 can include electric, hydraulic, or steam designs. The blade 215 can include fixed or variable blade configurations or include high-pressure water cutters types.

FIG. 4 further illustrates the feature of each side frame component pivoting about its pivot point for quick access to the motor 212 and the blade 215. A first side frame component pivot point 204 allows said side frame component to swing open and allow access to motor cavity 213. A second side frame component pivot point 208 allows said side frame component to open and allow access to motor cavity 213. Said pivot points are anchored within a plate member 214 where said plate member also allows the motor 212 direct access to the blade 215 via a plate member void 217. The motor 212 is steadied by each side frame component (203 & 207) via a motor brace 211. The steadying of the motor 212 can be performed by simple restriction by the braces 211 or the motor 212 can be attached to the braces 211 by a screw or other fastener. The securing of the motor 212 by each single side frame component (203 & 207), via braces 211 stabilizes operation and allows for multiple motor 212 types and configurations to be utilized in the field with the removable root cutting system 200. These elements form a rugged root cutting system capable of carrying one of a multitude of motors 212 and blades 215 and apply them in a frame system appropriate for sewer field use.

With continued reference to FIG. 4, within the illustrated embodiment of the present invention, each of the mating plates (206 & 210) possess a void 218 such that each mating plate void 218 lines up with the other mating plate voids 218 when all the side frame components are pivoted into the mated position. The voids allow a connection hose adapter 216 to pass through and connect to the payload, effectively locking all side frame components into the closed or mated position and forming an operational state of the removable root cutting system 200. This locking state will remain effective, keeping the removable root cutting system 200 in an operational state, until such time as the connection hose adapter 216 is removed. This construction allows for the removable root cutting system 200 to consist of a small number of parts with no alignments or adjustments required and is therefore very durable and adaptable in the field. The simple and effective opening and closing removable root cutting system 200 is capable of supporting multiple payload missions within a single operations staff fielding.

The foregoing disclosure and description of the invention are illustrative and explanatory thereof, and various changes in the size, shape and materials, as well as in the details of the illustrated construction may be made without departing from the spirit of the invention.

What is claimed is:

1. A removable frame system for supporting a subsystem payload having a first end with a payload application device and a second end with a connection hose adapter, the invention comprising:

at least a first side frame component having a first end and an opposing second end and a second side frame component having a first end and an opposing second end; the first end of the first side frame component connected to a first pivot point for pivoting of the first side frame component about the first pivot point, and the first end of the second side frame component connected to a second pivot point for pivoting of the second side frame component about the second pivot point;

the first and second side frame components formed having wings to support the payload centrally within a desired tube or conduit;

a plate member with at least a first surface and a second surface and at least a first and a second opposing edges; the plate member having a void therethrough extending between the first and second surfaces;

the first pivot point being associated with the first edge of the plate member, and the second pivot point being associated with the second edge of the plate member; the first and second side frame components pivot into a mated position about the respective pivot forming a central cavity between the first and second side frame components; the central cavity is adapted to accept the payload therein with the first end of the payload associated with the first end of the removable frame system;

the second end of the first side frame component formed having a mating plate that is essentially parallel to the first surface of the plate member when the first side frame component is in the mated position;

the second end of the second side frame component formed having a mating plate that is essentially parallel to the first surface of the plate member when the second side frame component is in the mated position; and the mating plate of the first side frame component formed having a void therethrough, and the mating plate of the second side frame component formed having a void therethrough; the void in the mating plate of the first side frame component and the void in the mating plate of the second side frame component align when the first and second side frame components are in the mated position to permit the connection hose adapter to extend through the aligned voids for attachment to a main system hose; whereby the attachment of the connection hose adapter and main system hose locks the first and second side frame components in the mated position.

2. The removable frame system of claim 1 wherein the removable side frame components are highly durable with no adjustments or removable parts to break during operation.

3. The removable frame system of claim 1 wherein the side frame components are included in a set of side frame components of a multitude of sizes for adaptation in the field to a multitude of tube or conduit dimensions.

4. The removable frame system of claim 1 wherein a desired number of side frame components operate as pivoting side frame components to support the removable frame system breakdown for repair, adjustment, or maintenance.

5. The removable frame system of claim 1 wherein the set of plate members supports a pass-through for a set of system power lines and communication lines for said frame system, payload, and payload application devices.

6. The removable frame system of claim 1 wherein the set of mating plates supports a pass-through for a set of system power lines and communication lines for said removable frame system, payload, and payload application devices.

7. The removable frame system of claim 1 wherein a set of front plates, capable of allowing the removable frame system payload direct access to the tube or conduit system, is a part of said system.

8. A remote root cutting system for supporting a motor drive subsystem having a first end supporting a set of add on accessories that includes a root cutting device and a second end supporting a connection hose adapter, the remote root cutting system comprising:

at least a first and a second side frame component each having a first end supporting a root cutting device and a second end supporting a connection hose adaptor: the first end of the first side frame component connected to a first pivot point for pivoting of the first side frame component about the first pivot point, and the first end of the second side frame component connected to a second pivot point for pivoting of the second side frame component about the second pivot point;

the set of side frame components having wings mounted thereon to support the motor and root cutting device within a desired tube or conduit;

the first end of the first side frame component including a plate member with at least a first surface and a second surface and at least a first and a second opposing edges; the plate member having a void therethrough extending between the first and second surfaces;

the plate member further having at least a first pivot point associated with the first edge, and a second pivot point associate with the second edge; the first and second side frame components pivot into a mated position forming a central cavity adapted to accept the motor therein the cavity with the first end of the motor associated with the first end of the remote root cutting system;

the first side frame component having a second end opposite the first end, the second end of the first side frame component formed having a mating plate that is essentially parallel to the first surface of the plate member when the first side frame component is in the mated position;

the second side frame component having a second end opposite the first end, the second end of the second side frame component formed having a mating plate that is essentially parallel to the first surface of the plate member when the second side frame component is in the mated position; and the mating plate of the first side frame component formed having a void therethrough, and the mating plate of the second side frame component formed having a void therethrough; the void in the mating plate of the first side frame component and the void in the mating plate of the second side frame component aligning when the first and second side frame components are in the mated position to permit the connection hose adapter to extend through the aligned voids for attachment to a main system hose; the attachment of the connection hose adapter and main system hose locks the first and second side frames in the mated position.

9. The remote root cutting system of claim 8 wherein the side frame components are highly durable with no adjustments or removable parts to break during operation.

10. The remote root cutting system of claim 8 wherein the side frame components are included in a set of side frame components of a multitude of sizes for adaptation in the field to a multitude of tube or conduit dimensions.

11. The remote root cutting system of claim 8 wherein a desired number of side frame components operate as pivoting e side frame components to support remote root cutting system breakdown for repair, adjustment, or maintenance.

12. The remote root cutting system of claim 8 wherein the set of plate members supports a pass-through for a set of system power lines and communication lines for said system, motor, and rooting cutting add-on device.

13. The remote root cutting system of claim 8 wherein the set of mating plates supports a pass-through for a set of: system power lines and communication lines, for said frame system, motor, and rooting cutting add-on device.

14. The remote root cutting system of claim 8 includes a set of front plates, capable of allowing said system motor and rooting cutting add-on device direct access to the tube or conduit system.

15. The remote root cutting system of claim 8 wherein the set of add-on accessories includes a set of monitoring sensors.

16. The remote root cutting system of claim 8 wherein the set of add-on accessories includes a set of video or audio sensors.

* * * * *